United States Patent [19]

Storer

[11] Patent Number: 4,916,862

[45] Date of Patent: Apr. 17, 1990

[54] CEILING ACCESS PANEL

[75] Inventor: Barrie W. Storer, Warwickshire, United Kingdom

[73] Assignee: Profilex Limited, Hinckley, United Kingdom

[21] Appl. No.: 281,539

[22] Filed: Dec. 8, 1988

[30] Foreign Application Priority Data

Dec. 9, 1987 [GB] United Kingdom ..... 8728728

[51] Int. Cl.[4] ..... E05F 1/10

[52] U.S. Cl. ..... 49/386; 16/72; 16/296

[58] Field of Search ..... 49/386, 381, 89, 273, 49/274, 379; 248/417; 16/1 C, 71, 78, 73, 72, 77, 289, 296

[56] References Cited

U.S. PATENT DOCUMENTS

| | | | |
|---|---|---|---|
| 71,478 | 11/1867 | Gould | 16/73 |
| 3,710,417 | 1/1973 | Berman et al. | 16/296 |
| 3,785,006 | 1/1974 | Metz | 16/73 |
| 4,226,001 | 10/1980 | Salice | 16/296 |
| 4,783,881 | 11/1988 | Ho | 16/72 |

FOREIGN PATENT DOCUMENTS

| | | | |
|---|---|---|---|
| 2603084 | 8/1976 | Fed. Rep. of Germany | 49/386 |
| 1049428 | 12/1953 | France | 16/72 |

*Primary Examiner*—James R. Brittain
*Assistant Examiner*—Gerald A. Anderson
*Attorney, Agent, or Firm*—Carothers & Carothers

[57] ABSTRACT

A ceiling access panel for a suspended ceiling has a friction brake to retard the pivotal movement of the panel from a raised condition flush with the ceiling to a lowered condition exposing a ceiling access opening. The friction brake comprises a flexible band having a first end anchored to the access panel, a second end fast to a bracket upstanding from the access panel, and an intermediate portion passing around and between a pair of rollers mounted on an access frame portion of the ceiling structure so that when the weight of the access panel is applied to the first end of the band, the band is drawn onto itself, frictionally to resist further lowering of the access panel.

11 Claims, 13 Drawing Sheets

CEILING ACCESS PANEL

DESCRIPTION

The invention relates to ceiling access panels, particularly but not exclusively those used in suspended ceilings, to permit access to concealed pipework and wiring above the ceiling structure. Two recent trends in the design of suspended ceilings have tended to make conventional ceiling access panel design unsatisfactory. The first trend is the tendency for architects to stipulate larger ceiling access openings, to permit more ready access to the pipework, ducting and electrical wiring above the ceiling level. The second influencing factor is the stipulation of progressively larger access panels for aesthetic reasons. Thus it is considered undersirable for a single large access opening to be fitted with two or more separate access doors or panels when a single panel is aesthetically much more pleasing.

Because of the weight of the fire retardant cladding which covers the access panel, relatively small access panels can be quite heavy to open. The larger size panels are extremely heavy and difficult to handle, particularly if they are wide as measured perpendicular to the hinge or pivot. Such wide panels involve a relatively larger lateral movement of the leading edge during opening and closing, so that if the person trying to obtain access to the ceiling space is working from a tall step-ladder, the operation of opening the access panel can be hazardous. It is relatively easy for the weight of the panel to unbalance the user, so that the panel swings down with considerable force and momentum, causing injury to anyone in its path and causing potential damage to its pivotal mounting and to the ceiling structure. These hazards are in addition to the risk of handling extremely heavy loads while on the top of a step-ladder, and the added risk that as the ceiling panel swings downwards, it also exerts a lateral force which can upset the step-ladder.

SUMMARY OF THE INVENTION

The invention provides a ceiling access panel having a friction brake to retard the pivotal movement of the panel from a raised condition flush with the ceiling to a lowered condition exposing a ceiling access opening, wherein the friction brake comprises a flexible band having a first end anchored on the access panel, a second end fast to a bracket upstanding from the access panel, and an intermediate portion passing around and between a pair of rollers mounted on an access frame portion of the ceiling structure so that when the weight of the access panel is applied to the first end of the band, the band is drawn onto itself, frictionally to resist further lowering of the access panel. Opening such a ceiling access panel avoids many of the hazards discussed above. There is no tendency for the panel to swing into its fully open position as soon as it is released, as the flexible band of the friction brake supports the weight of the panel as soon as the band is drawn onto itself.

Preferably the band passes around and between the rollers in such a manner that when the weight of the access panel is applied to the first end of the band an outer turn of the band is drawn against an inner turn on one of the rollers, to lock the turns of the band against relative movement after initial slippage. The access panel is then lowered in stages. When initially released, there is initial slippage of the band until the outer turn of the band is drawn against the inner turn and the band is drawn onto itself frictionally to resist further lowering of the access panel. Thereafter the user must repeatedly support the weight of the access panel and then release that weight to generate, on each such release, similar initial slippage of the turns of the band to permit some partial and progressive lowering of the access panel before locking of the band takes place.

The bracket which is upstanding from the access panel and which supports the second end of the band permits return movement of the access panel without locking the band between the rollers. In particular, by passing the band over the upstanding bracket the access panel can be designed so that simple movement of the access panel from its lowered condition to its raised condition flush with the ceiling causes the band to be drawn freely through the rollers of the friction brake.

The invention also provides a ceiling access panel pivotally movable from a raised condition flush with the ceiling to a lowered condition exposing a ceiling access opening, wherein a latch mechanism at a leading edge of the access panel comprises an upstanding latch member on the access panel, receivable in a downwardly opening latching recess in a detent assembly fast to the ceiling frame. The detent assembly comprises a detent roller freely movable in inclined tracks in side walls of the recess. Movement of the latching member into the detent recess pushes the roller upwardly and laterally to permit passage of a leading portion of the latching member past the detent roller which is then free to roll back down its track to a detent position beneath a downwardly facing shoulder of the latching member.

The above latching mechanism is particularly simple to use, since to engage the latch the panel simply has to be pushed upwardly into the plane of the ceiling. To release the latch mechanism a special lifting tool is preferably provided, consisting of a pole having a relatively broad first end which engages in a recessed housing in the ceiling access panel and permits the user, via the lifting tool, to lift the access panel to its fully closed condition. The second end of the lifting tool preferably comprises a lifting shoulder for taking the strain of the total weight of the panel, but preferably with a relatively thin actuating portion which passes through the recessed housing and actuates a detent release member which is positioned beneath the detent portion of the detent roller. The detent release member is liftable to push the detent roller along its inclined tracks to a release position laterally to one side of the downwardly facing shoulder of the latching member.

If both the friction brake and the latch mechanism described above are incorporated into the same ceiling access panel, then there is provided a panel which is both safe and simple to use, even on exceptionally high ceilings when the use of a step-ladder is essential.

DRAWINGS

Figure 1:
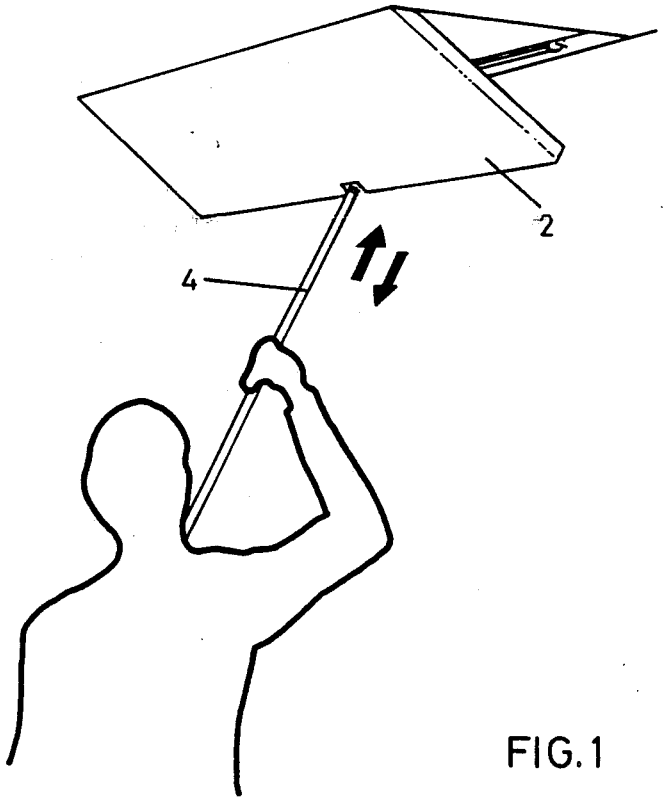
FIG. 1 is a schematic illustration of the opening of a ceiling access panel of the invention.

Referring first to FIGS. 1 to 7, there is illustrated a ceiling access panel having a friction brake and a roller latch mechanism according to the invention. FIG. 1 shows schematically the action of opening the access panel 2, using an operating rod 4 the construction and function of which will be described in greater detail below.

The pivotal mounting of the access panel 2 is basically as described in British Patent number 1568673, in which a fixed pivot rod or bar 6 is provided, fast to the access frame portion of the ceiling structure. A pair of upstanding brackets 8, one at each end of the ceiling access panel 2, are each provided with a generally arcuate slot 10 receiving the rod 6. The brackets 8 slide relative to the rod 6 as the access panel is lowered, with the rod 6 effectively traversing the length of the slot 10 (see FIGS. 3 and 5). Movement of the brackets 8 back over the rod 6 during the final stages of closure of the access panel is facilitated by a cam follower 12 at each end of the ceiling access panel, each cam follower 12 traversing a cam track 14 during the last stages of the closing movement. The same cam track 14 is a valuable safety feature during opening of the access panel, since after opening for only a few degrees the cam follower 12 is constrained by the weight of the ceiling access panel to enter a short blind detent recess 16 (FIG. 5) in the nylon moulding which forms the cam track 14. Thus even if the access panel is opened unintentionally, it can fall only a few degrees before its further movement is prevented by the couple between the pivot rod 6 and the cam follower 12 and the blind recess 16. If the opening movement is intentional, then the user must lift the cam follower 12 out of the recess 16 and down outwardly through the open throat of the cam track 14.

Figure 4:
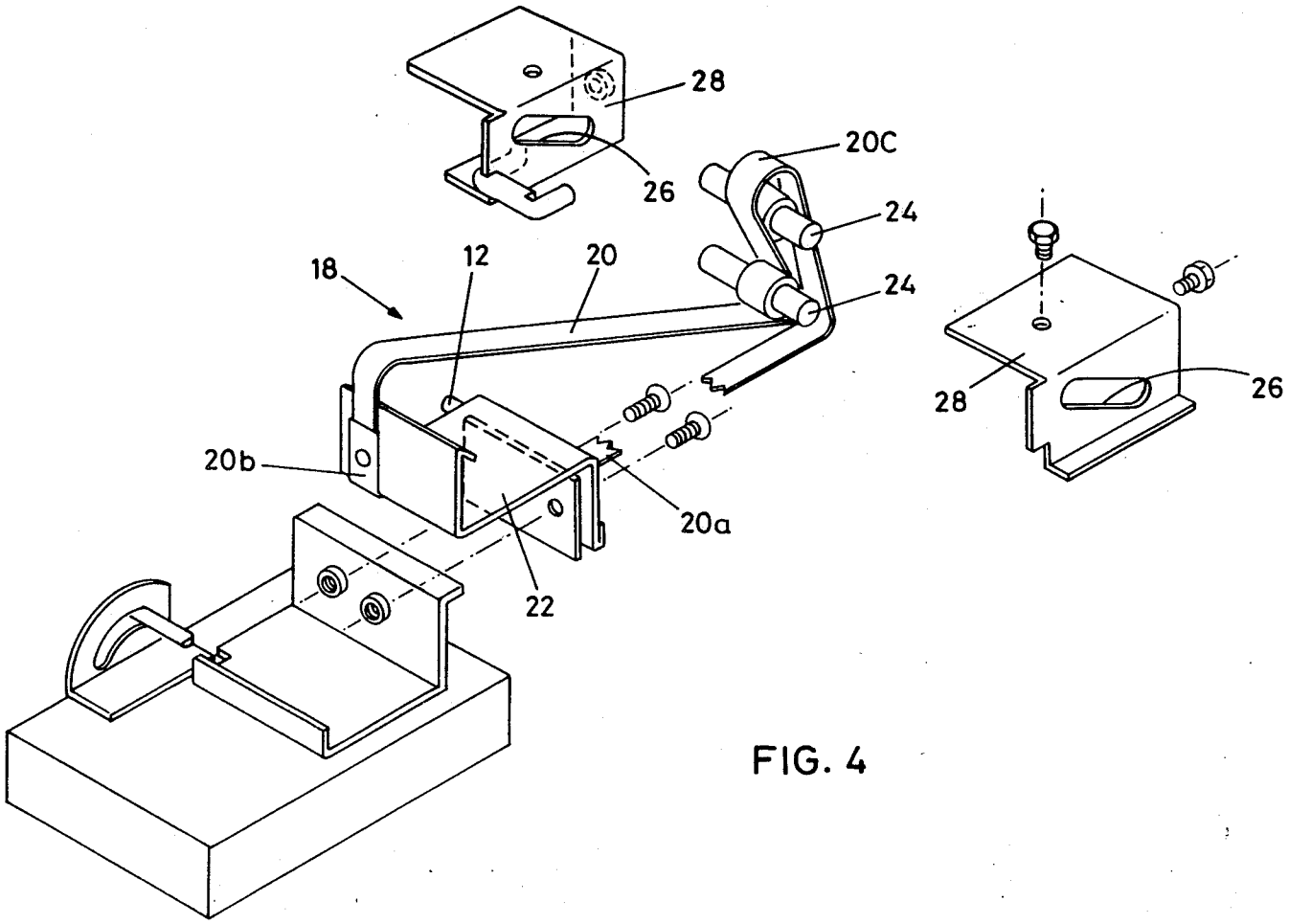
FIG. 4 is an exploded perspective view of the components of the access panel pivotal mounting and friction brake of FIGS. 2 and 3.
Figure 5:
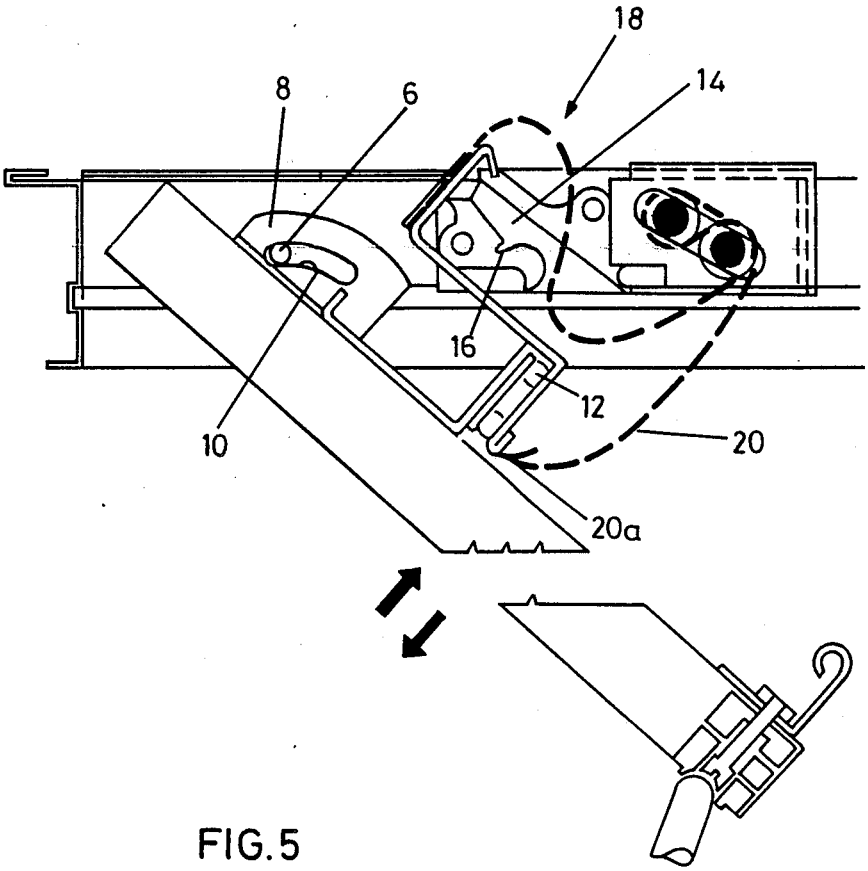
FIG. 5 is a vertical section through the ceiling access panel of FIG. 1, illustrating the operation of the friction brake and the roller latch mechanism.

Continued downward movement of the access panel is under the control of a friction brake 18 according to the invention. A flexible tape or band 20 has a first end 20A anchored to an upper surface of the ceiling access panel and a second end 20B anchored to an upstanding web 22 on the top face of the ceiling access panel. An intermediate portion 20C passes around and between a pair of rollers 24 the ends of which are freely slidable and rotatable in slots 26 in a pair of bracket members 28 which are secured fast to the access frame of the ceiling structure. The wrapping of the band 20 between and around the rollers 24 is best seen in FIG. 4, from which it will be understood that the rollers are freely movable in the slots 26 and that when the weight of the panel falls downwardly on the first end 20A of the flexible band 20, that band will be drawn onto itself as it passes over the bottom roller 24, so that the band becomes completely locked. This is sufficient to support the weight of the ceiling access panel, and prevent it from becoming further lowered.

The Applicants have found that the above locking is not instantaneous, but there is a certain initial slippage of the band before the contacting turns lock the band against further relative movement. This limited slip is probably due to inherent flexural elasticicty in the tape or band material, which tends to move the rollers 24 apart in their tracks 26 when the tension is released from the band 20. Thus to lower the panel, it is necessary simply repeatedly to support the weight of the access panel and then to release that weight to generate, on each such release, a similar initial slippage of the turns of the band to permit some partial lowering of the access panel before further locking of the band takes place. Using the operating pole or rod 4 illustrated in FIG. 1, therefore, the user would initially release the latch holding the panel in the plane of the ceiling, lift the cam follower 12 over the blind slot or recess 16 and allow the friction brake 18 to hold the panel in a partly lowered condition. Thereafter if the rod 4 is then repeatedly pushed and relaxed, each push will support the weight of the access panel to an extent sufficient to separate the rollers 24 and ensure that, on each release, there is a similar initial slippage of the turns of the band and a further partial lowering of the access panel.

Figure 2:
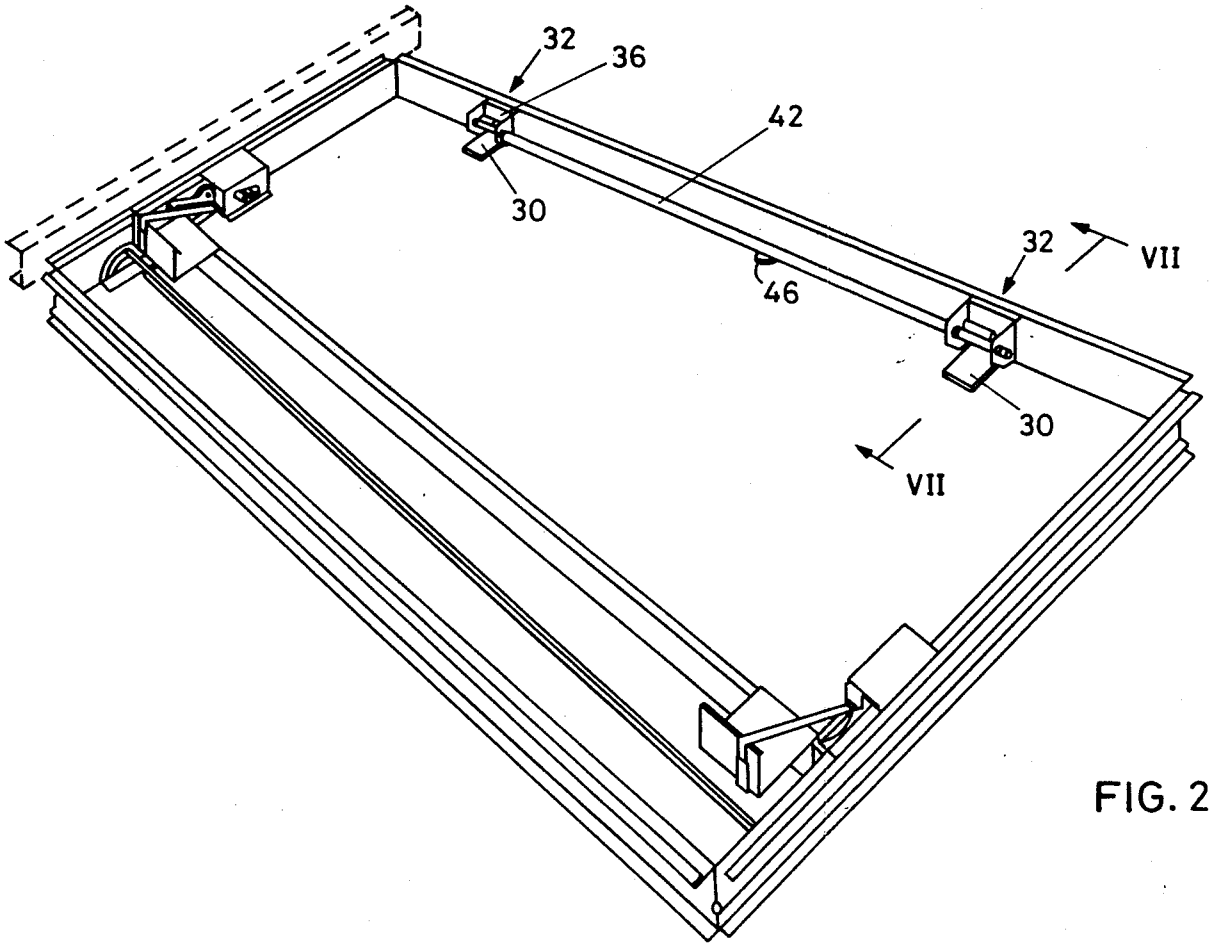
FIG. 2 is a perspective view from above of the ceiling access panel of FIG. 1, showing the friction brake for controlling the opening movement and the roller latch mechanism for maintaining the door closed.
Figure 3:
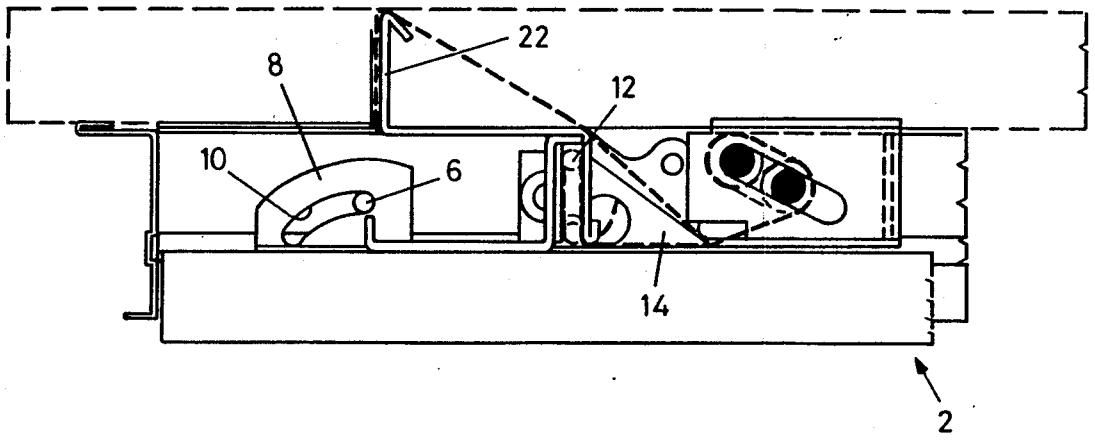
FIG. 3 is a side elevation of the friction brake of FIG. 2.
Figure 6:
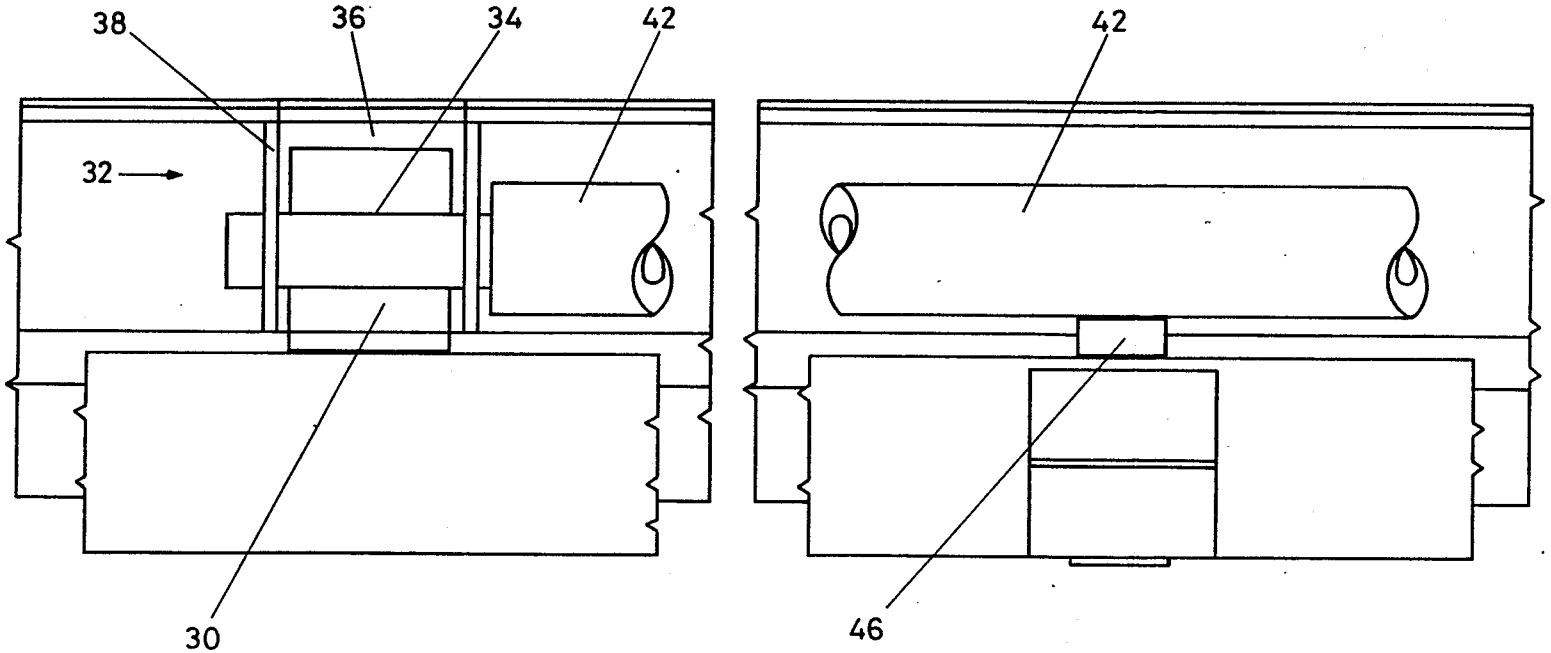
FIG. 6 is a front elevation of the roller latch mechanism of FIG. 2.
Figure 7A:
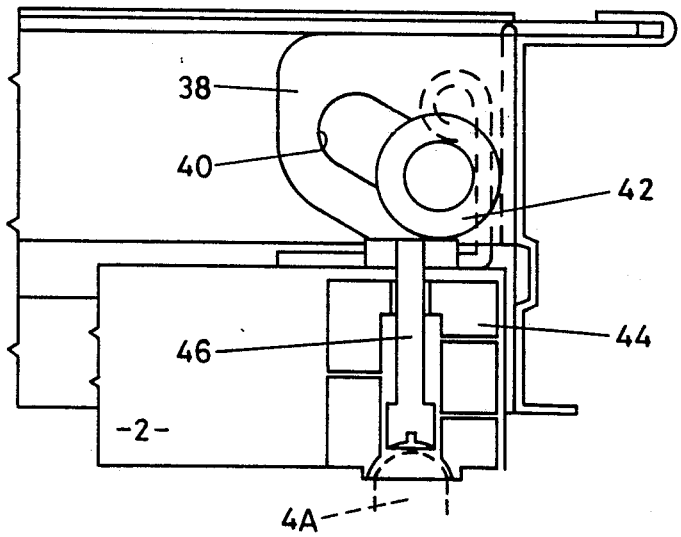
FIGS. 7A and 7B are vertical sections taken along the line VII—VII of FIG. 2 in the fully latched and half latched conditions respectively.

Referring next to FIGS. 2, 6 and 7, there is illustrated a latch mechanism according to the invention for latching the access panel into its fully closed position flush with the ceiling. The latch mechanism comprises a pair of upstanding latch members 30 fast to the ceiling access panel 2 and one at each end portion of the ceiling access panel, each cooperating with a detent assembly 32 fast to the access frame portion of the ceiling structure. The upper edge of each upstanding latch member 30 is rolled so as to provide a downwardly facing shoulder 34 which in use supports the weight of the access panel.

Each detent assembly 32 comprises a frame 36 (FIGS. 2 and 6) having side walls 38 in which are formed inclined tracks 40. Straddling the tracks 40 of both frames 36 is a freely floating roller member 42, the size and position of the frames 36, the side walls 38 and the roller 42 being such that when the access panel 2 is raised, the rolled noses of the latching members 30 pushes the respective end portions of the roller 42 upwardly and laterally in their tracks 40, until the latching members can pass to the side of the roller, and until ultimately each end of the roller falls back down to the bottom of its track 40, beneath the downwardly facing shoulder 34 of the respective latching member 30.

Figure 7B:
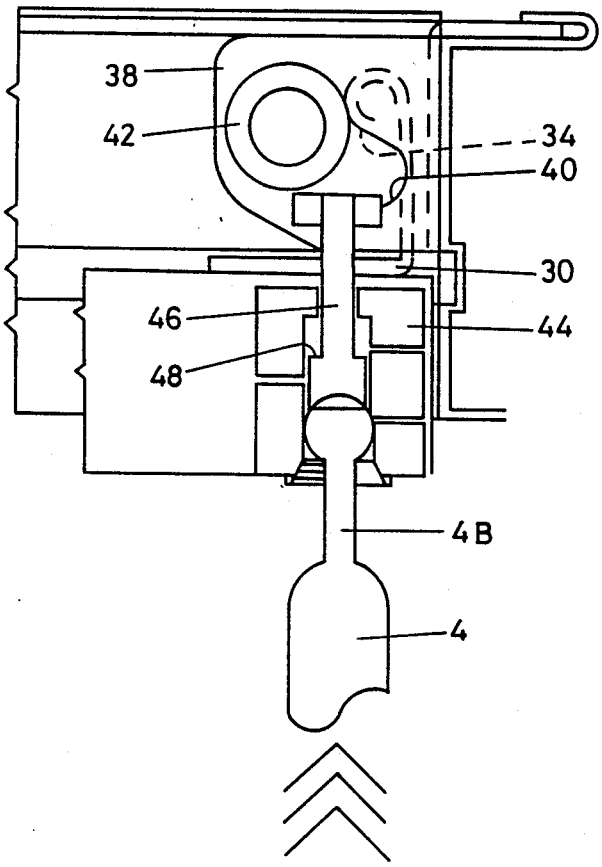
Figure 8:
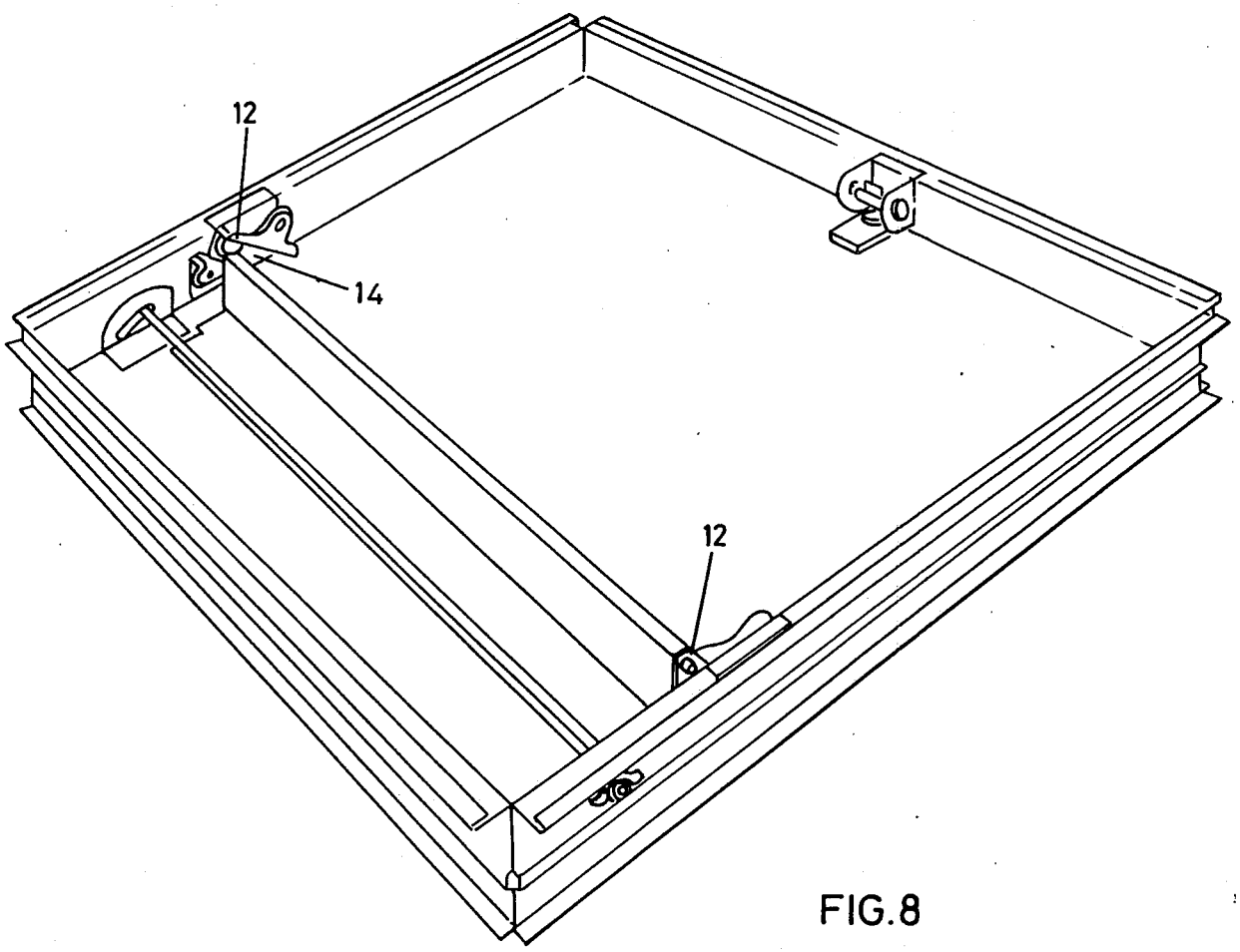
FIG. 8 is a perspective view similar to that of FIG. 2 but of a smaller ceiling access panel incorporating a modified roller latch mechanism but no friction brake for controlling the opening movement.
Figure 9:
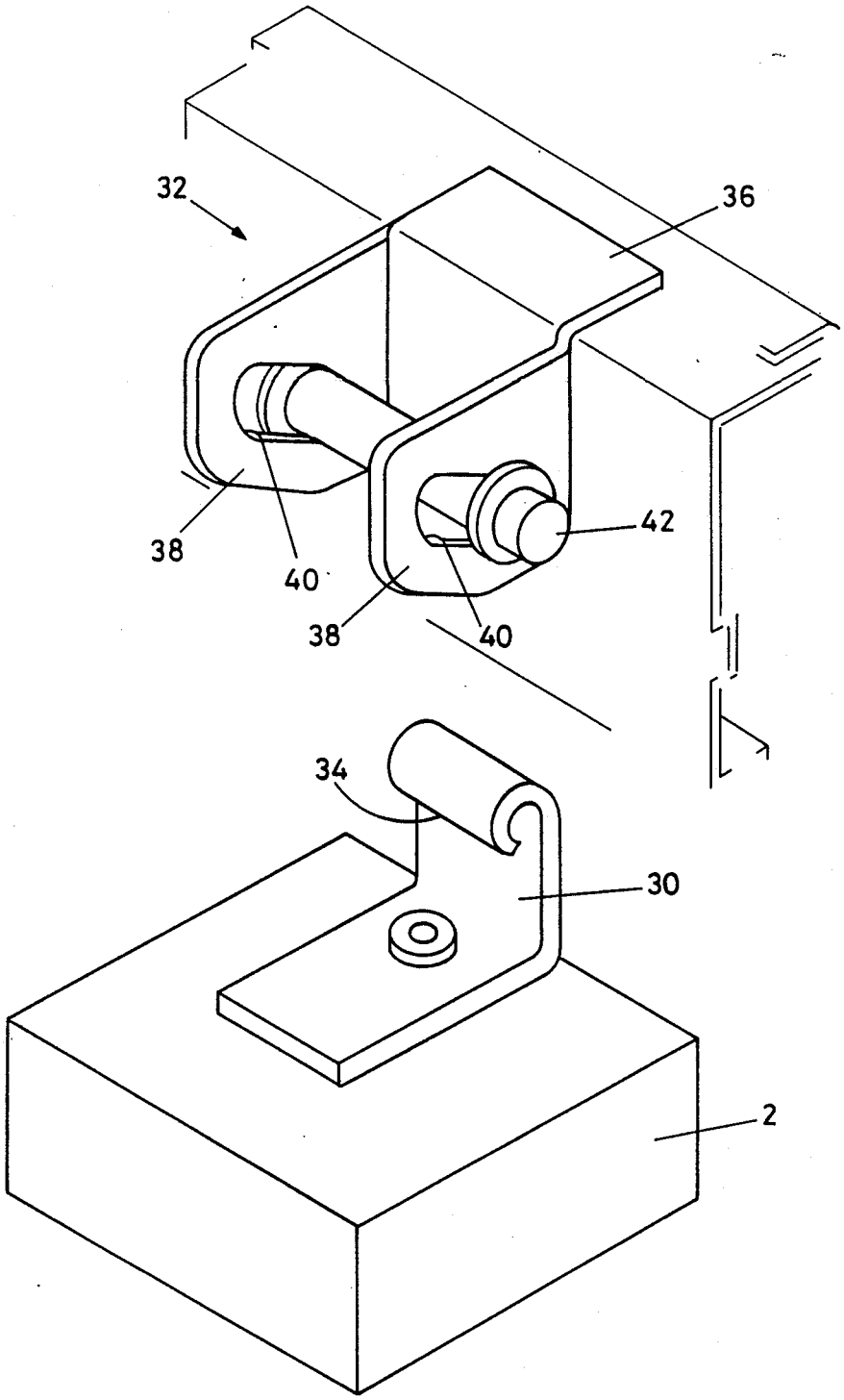
FIG. 9 is a perspective view of the components of the roller latch mechanism of FIG. 8.
Figure 10:
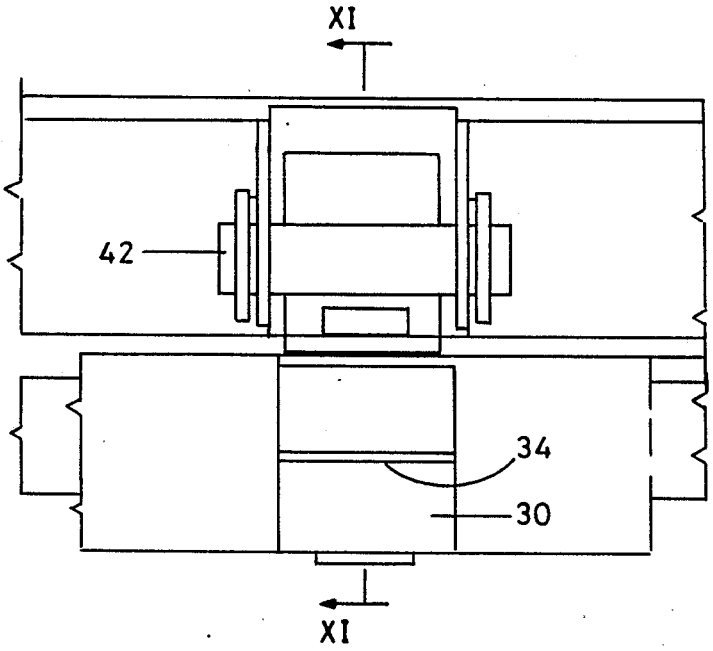
FIG. 10 is a front elevation of portions of the roller latch mechanism of FIG. 8.

The leading edge of the access panel 2 is formed with a recessed housing member 44 which receives a rounded end 4A of the opening pole or rod 4, for lifting the access panel 2 into its fully closed condition. Positioned immediately above the recess in the housing member 44 is a smaller diameter pin portion of a detent release member 46. The lifting or opening pole or rod 4 has at one end a portion of narrower diameter 4B, which portion can pass through the main support seat of the recessed housing 44, to lift the detent release member 46. The lifting or opening pole or rod 4 has at one end a portion of narrower diameter 4B, which portion can pass through the main support seat of the recessed housing 44, to lift the detent release member 46 as shown in FIG. 7B. The detent release member 46 is located midway of the rod 42, so that insertion of the narrow end 4B of the opening pole 4 causes the single detent release member 46 to lift the rod 42 until both ends of the rod are pressed firmly to the top ends of the respective tracks 40. In this condition, the latching engagement is released simultaneously at both latch mechanisms. As soon as the latching engagement with the roller 42 is released, the ceiling access panel 2 is permitted to fall onto a shoulder portion 48 of the detent release member 46, permitting the ceiling member access panel to be supported by the operating pole or rod 4 during the subsequent opening movement of the access panel.

The latch mechanism illustrated in FIGS. 6 and 7 would be suitable for relatively large sized access panels. For smaller size doors the latching mechanism should preferably be modified as illustrated in FIGS. 8 to 11, in which the same reference numerals have been used as far as possible as those used in connection with FIGS. 6 and 7.

In the latch mechanism of FIGS. 8 to 11 instead of the two spaced latching members 30 there is provided, at a central position along the leading edge of the ceiling access panel, a single latching member which has its own detent assembly 32. The detent assembly 32 has a single detent rod or roller 42 the ends of which are freely slidable in the inclined slots 40 in the side walls 38 of the frame 36. When the opening pole or rod 4 is used with the access panel of FIGS. 8 to 11, an upper portion of the detent release member 46 contacts the underside of the roller 42, to lift the roller and slide it laterally along the tracks 40, so as to release the detent contact with the downwardly facing shoulder 34 of the latching member 30.

The illustrated construction provides a number of safety advantages over known access panels. The operating pole or rod 4 can be made long enough to make the use of step-ladders unnecessary in a variety of situations and for all but extremely high ceilings. Whether working from a step-ladder or from the floor, however, the possibility of an accident during opening or closing of the access panel is much reduced over the prior art. Latch release is simple, and is obtained only when the release rod 4 is used with its narrow end 4B uppermost and is pushed firmly upwardly to support the weight of the access panel. The lowering movement is progressive and controlled, with an initial safety lock being provided by the recess 16 in the cam track 14 after only a few degrees of opening, and thereafter by repeated locking of the friction brake 18 which prevents an uncontrolled downward swinging of the access panel.

Figure 11A:
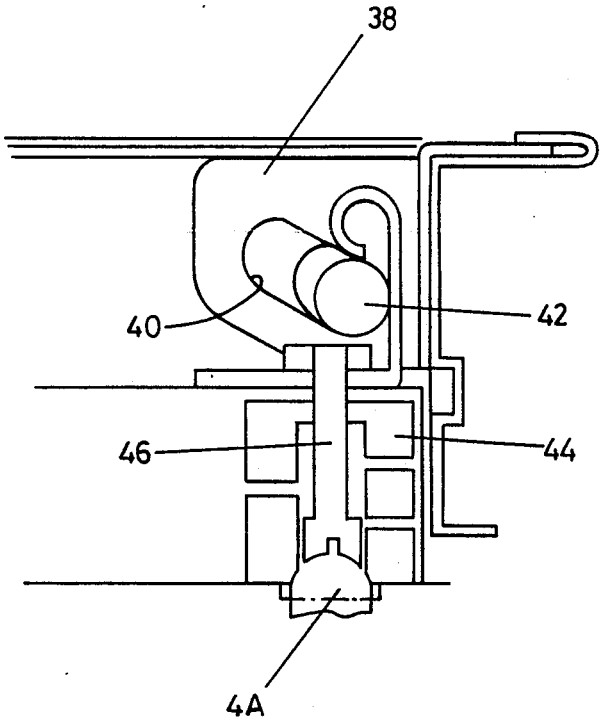
FIGS. 11A and 11B are vertical sections taken along the line X1—X1 of FIG. 10 in the fully latched and half unlatched conditions respectively.
Figure 11B:
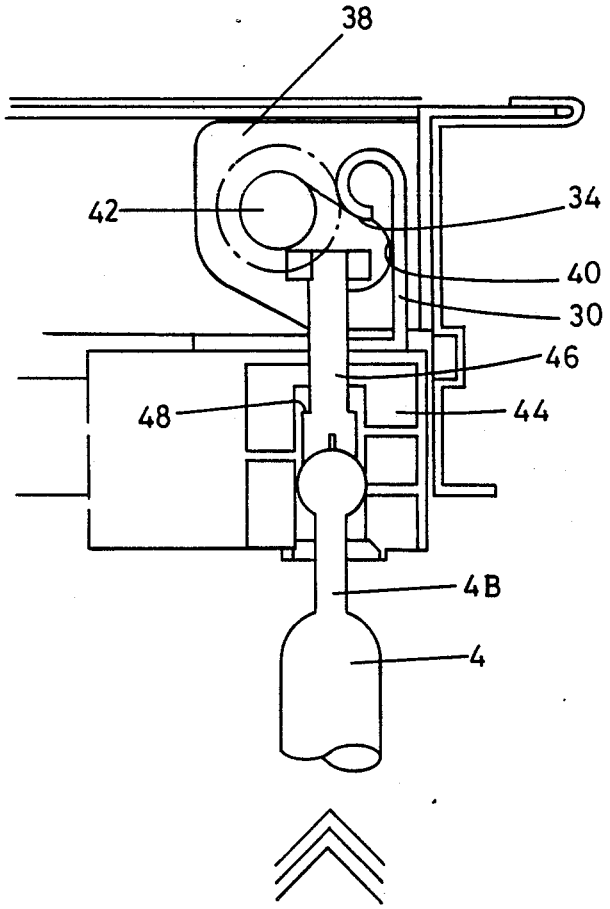

Closure of the access panel of the invention is equally simple. The operating rod 4 is reversed, and its broader end placed in the rounded recessed mouth of the housing 44 as shown in FIGS. 6 and 11A. The access panel can then simply be pushed upwardly using the operating rod, as shown FIG. 1. The upstanding flange 22 acts to draw the tape freely through the nip of the rollers 24, but if at any time during the closing sequence the panel is released, its weight is again applied to the first end 20A of the tape, locking the tape around the rollers and supporting the weight of the panel.

I claim:

1. A ceiling access panel assembly comprising:

an access panel mounted for pivotal movement with respect to a frame, a friction brake which is operable to retard such pivotal movement of said panel from a raised condition flush with a ceiling to a lowered condition exposing a ceiling access opening, said friction brake comprising a flexible band having a first end anchored on said access panel and a second end fast to a bracket upstanding from said access panel, a pair of rollers mounted on said frame for rotation on adjacent axes, said flexible band having an intermediate portion between said first and second ends which passes around and between said rollers so that when the weight of said access panel is applied to said first end, said band is drawn onto itself, frictionally to resist further pivotal movement of said access panel toward such a lowered condition.

2. An access panel assembly according to claim 1 wherein said band passes around and between said rollers in such a manner that when the weight of said access panel is applied to said first end, an outer turn of said band is drawn against an inner turn thereof on one of said rollers, to lock said inner and outer turns of said band against relative movement after initial slippage thereof, whereby movement of said access panel from such a raised condition to such a lowered condition is achieved by repeatedly supporting the weight of said access panel and releasing the weight thereof to generate, on successive such releases, repeated initial slippage of said turns of said band to permit with each such release some partial lowering of said access panel before further locking of said band.

3. An access panel assembly according to claim 1 wherein raising said access panel from such a lowered condition to such a raised condition causes said upstanding bracket to draw said band freely between said rollers.

4. An access panel assembly according to claim 1 wherein said rollers are retained in elongated slots or tracks formed in a mounting which is secured fast to said frame.

5. An access panel assembly according to claim 4 wherein said rollers are free-floating in said slots or tracks such that the respective axes of rotation thereof are movable toward and away from one another.

6. An access panel assembly according to claim 1 wherein said panel is retained with respect to a fixed pivot rod which is mounted fast to said frame, said access panel including support brackets having elongated cam tracks within which said pivot rod is received so that on lowering said panel said cam tracks are traversed by said pivot rod.

7. An access panel assembly according to claim 6 additionally including a cam follower mounted on said panel and engageable in a further cam track mounted fast to said frame for guiding movement of said panel in the final stages of closure thereof, and a detent recess in said further cam track which receives said cam follower to restrain said panel during opening thereof independently of said friction brake in a partially open condition adjacent such a fully raised condition.

8. An access panel assembly according to claim 1 including a latch mechanism positioned adjacent a leading edge of said panel and comprised of an upstanding latch member on said access panel which is receivable in a downwardly opening latching recess formed by a detent assembly mounted fast to said frame, said detent assembly comprising a detent roller freely movable in inclined tracks formed by side walls of said latching recess whereby movement of said latch member into said latching recess pushes said detent roller upwardly and laterally to permit passage of a leading portion of said latch member past said detent roller which is then free to move down said inclined tracks to a latching position beneath a downwardly facing shoulder of said latch member.

9. An access panel assembly according to claim 8 further comprising a detent release member positioned beneath the latching position of said detent roller and movable upwardly to push said detent roller upwardly along said inclined tracks to a release position laterally to one side of said downwardly facing shoulder of said latch member.

10. An access panel assembly according to claim 8 wherein said latch mechanism comprises a pair of spaced latch members each receivable in a respective latching recess of said detent assembly, and wherein said detent roller is a unitary rod spanning both of said latching recesses.

11. A ceiling access panel assembly including a panel pivotally movable from a raised condition with respect to a frame to a lowered condition to expose a ceiling access opening, wherein a latch mechanism mounted adjacent a leading edge of said access panel comprises an upstanding latch member mounted on the access panel and receivable on a downwardly opening latching recess formed in a detent assembly mounted fast to such a frame, said detent assembly comprising a detent roller freely movable in inclined detent tracks formed in side walls of said latching recess whereby movement of said latch member into said latching recess on closure of the panel pushes said roller upwardly and laterally to permit passage of a leading portion of said latch member past said detent roller which is then free to move down said detent tracks to a latching position beneath a downwardly facing shoulder of said latch member.

* * * * *